US011491526B2

(12) United States Patent
Berghaus et al.

(10) Patent No.: US 11,491,526 B2
(45) **Date of Patent: *Nov. 8, 2022**

(54) SHAPING TOOL FOR A WORKPIECE, AND DEVICE FOR DEFORMING A WORKPIECE USING SUCH A TOOL

(71) Applicant: VOSS Fluid GmbH, Wipperfurth (DE)

(72) Inventors: Gerd Berghaus, Kurten (DE); Harald Pott, Huckeswagen (DE); Heinz-Werner Papenhoff, Hattingen (DE); Alexander Erbe, Huckeswagen (DE)

(73) Assignee: VOSS Fluid GmbH, Wipperfurth (DE)

( * ) Notice: Subject to any disclaimer, the term of this patent is extended or adjusted under 35 U.S.C. 154(b) by 320 days.

This patent is subject to a terminal disclaimer.

(21) Appl. No.: 16/570,763

(22) Filed: Sep. 13, 2019

(65) Prior Publication Data

US 2020/0001341 A1 Jan. 2, 2020

Related U.S. Application Data

(63) Continuation of application No. 15/126,862, filed as application No. PCT/EP2015/055878 on Mar. 20, 2015, now Pat. No. 10,449,588.

(30) Foreign Application Priority Data

Mar. 20, 2014 (DE) ..... 102014103799.5

(51) Int. Cl.

| | |
|---|---|
| ***B21D 41/00*** | (2006.01) |
| ***B21D 17/02*** | (2006.01) |
| ***B21D 41/04*** | (2006.01) |

(52) U.S. Cl.
CPC ..... *B21D 17/025* (2013.01); *B21D 41/04* (2013.01)

(58) Field of Classification Search
CPC ..... B21D 41/00; B21D 41/02; B21D 41/025; B21D 17/02; B21D 17/025; B21D 39/08; B21D 41/04; B21D 19/08
See application file for complete search history.

(56) References Cited

U.S. PATENT DOCUMENTS

| | | | |
|---|---|---|---|
| 5,134,872 | A | 8/1992 | Ose |
| 7,353,682 | B2 | 4/2008 | Buchanan |

(Continued)

FOREIGN PATENT DOCUMENTS

| | | | |
|---|---|---|---|
| CN | 1447724 | A | 10/2003 |
| DE | 19511447 | A1 | 10/1996 |

(Continued)

*Primary Examiner* — Debra M Sullivan
(74) *Attorney, Agent, or Firm* — Eric J. Sosenko; Jonathan P. O'Brien; Honigman LLP

(57) ABSTRACT

A shaping tool for connecting to a shaping device for deforming a portion of a workpiece. The shaping tool includes a clamping device having multiple clamping segments and a compressing head having a depression on one end for forming a portion of the workpiece. The compression head and the clamping device being integrally connected to each other, circumferentially, as a wholly exchangeable single tool unit and being axially movable relative to each other. The compression head additionally, on an opposing side from the depression, an attachment feature for connecting the single tool unit to a shaping piston of a shaping device.

14 Claims, 7 Drawing Sheets

(56) References Cited

U.S. PATENT DOCUMENTS

| | | | | |
|---|---|---|---|---|
| 10,449,588 | B2 * | 10/2019 | Berghaus | B21D 17/025 |
| 2001/0035038 | A1 | 11/2001 | Ose | |
| 2005/0150270 | A1 | 7/2005 | Berghaus | |

FOREIGN PATENT DOCUMENTS

| | | | |
|---|---|---|---|
| DE | 10040595 | A1 | 3/2002 |
| DE | 102009022957 | A1 | 12/2010 |
| EP | 1311358 | B1 | 5/2003 |
| EP | 1494827 | B1 | 1/2005 |
| GB | 2352665 | A | 2/2001 |

* cited by examiner

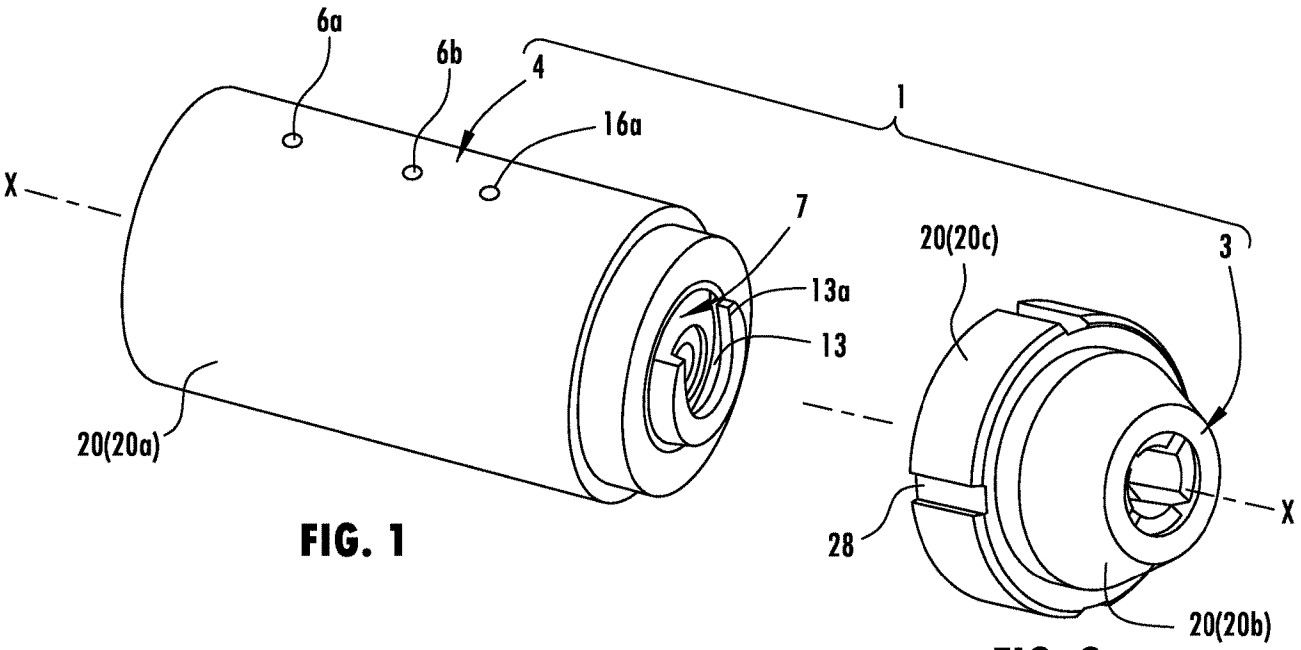
FIG. 1
FIG. 2
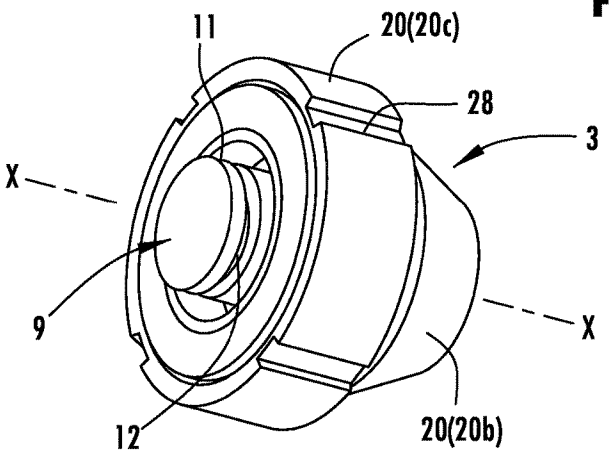
FIG. 3

SHAPING TOOL FOR A WORKPIECE, AND DEVICE FOR DEFORMING A WORKPIECE USING SUCH A TOOL

CROSS REFERENCE TO RELATED APPLICATIONS

This application is a continuation of U.S. application Ser. No. 15/126,862 filed Sep. 16, 2016, which is a U.S. national phase of PCT application no. PCT/EP2015/055878 filed on Mar. 20, 2015, which claims priority to DE 10 2014 103 799.5 filed on Mar. 20, 2014, the disclosures of which are herein incorporated in their entirety by reference.

BACKGROUND

1. Field of the Invention

The present invention relates to a shaping tool for a workpiece, in particular for plastic shaping of a tube end, with a clamping device, including a plurality of clamping segments, for the workpiece and with a compression head, which in particular includes on one side a recess for forming a to-be-shaped contour of the workpiece and on the opposing side an attachment means for connecting to a shaping piston of a device for deforming the workpiece.

Furthermore, the present invention relates to a device for deforming a workpiece with a shaping subassembly actuatable by the pressure of a fluid and with a clamping subassembly disposed on a common longitudinal axis, actuatable by the pressure of the fluid.

2. Description of Related Art

A shaping tool and a device of the type mentioned are known from EP 1 494 827 B1. This document describes a device for shaping of workpieces, in particular for plastic shaping of tube ends, with a shaping subassembly actuated by the pressure of a fluid—referred to there as a shaping unit—and with a clamping subassembly disposed on a common longitudinal axis and actuated by the pressure of a fluid—referred to there as a preloading unit—wherein conically configured clamping elements are provided for the workpiece. A toolset is used here for shaping and is comprised of a compression head as a compression tool and of a clamping device belong to the clamping elements. On one side the compression head contains a depression that forms a counter-contour of the to-be-formed tube contour, and on the opposite side contains an attachment means that can be attached to a corresponding connection point of a piston of the shaping subassembly, e.g., in a T-groove. The clamping device is preferably formed from a plurality of, preferably four, annularly disposed segments that function as clamping jaws. These are usually guided via cylindrical pins and held in an opening position in the unloaded state via pressure springs disposed between them. They interact with a conical surface in an opening of a yoke plate of the shaping subassembly of the device for shaping and for this purpose also have conically configured outer surfaces. During clamping the clamping jaws press onto the tube with their usually slightly roughened or toothed inside.

For the technologically important step of the tool change, it is embodied in the mentioned EP 1 494 827 B1 that a removal of device components for tool change is not required, and in a tool-change position, the tools—compression head and clamping device—can be inserted from above in corresponding openings of the shaping device, wherein a good accessibility to the tool space is provided.

In detail, with a tool change—which is not described in the document mentioned but is known from a device available on the market for deforming a tool—the process of a tool changeover can be characterized in a constructively simple embodiment by the following steps: opening a tool-change push valve of a housing of the shaping device, which housing has a basically cylindrical shape and surrounds the compression head and the clamping jaws in its work position, by pulling open by hand, inserting or changing the clamping device, inserting or changing the compression tool, e.g., by inserting into the T-groove, closing the tool-change push valve by pushing closed by hand.

Here the process represents an already optimized variant to a comparatively more complex known process of tool changeover, which is practicable, for example, with a device according to EP 1 311 358 B1 and, in particular to ensure a high assembly security, comprises the following steps: unscrewing a housing of the shaping device for the compression head and the clamping jaws, which housing has a basically truncated-cone shape, inserting or changing the clamping device, screwing-in or changing the compression tool using a special key, closing again and screwing together the housing. Here there is the risk that the clamping-jaw segments fall apart, since during the assembly they are usually held together only by a rubber ring. Furthermore the change is time consuming due to the required tool use.

It is disadvantageous in both variants that due to the space requirement necessary for the tool change the shaping region is relatively large, which leads to limitations of possible bending geometries of a to-be shaped tube, and that there is a risk of confusion of respectively mutually associated pairings of compression head and clamping device.

DE 100 40 595 A1 describes a device of the above-mentioned type and a method for shaping an end region of a workpiece, in particular for cold-press shaping of a tube end region, wherein a first hydrodynamically actuatable force transmission element for clamping the workpiece and a second hydrodynamically actuatable force-transmission element, by whose force effect the shaping is achieved, are provided. The shaping device here includes in its specific embodiment a two-part housing that is formed from a base housing and from a receptacle housing. The base housing includes a central cylindrical bore wherein an outer piston and an inner piston are guided. A compression tool is thus connectable via a rotary lock. The receptacle housing forms a receiving space for clamping jaws that are actuatable by actuating the outer piston. The assembly of the deforming tool is not described in detail, however in an analysis of the Figure drawings it appears complex in terms of assembly.

U.S. Pat. No. 5,134,872 A also describes a hydraulic clamping device for expanding a tube end. The device includes a tube-receiving end into which the to-be-expanded tube is inserted. A main piston is contained in a chuck, which main piston can be moved forward towards the tube receiving end and back again under the effect of the fluid. At one end of the main piston there is a ball for widening the tube, which ball is attached via a screw. Inside a housing are the collets, which are driven via an actuator, which in turn is screwed to a hollow actuating piston, in whose interior the main piston slides. Due to the many individual parts to be connected to one another the assembly and disassembly effort also appears disadvantageously large for this device.

SUMMARY

The object of the present invention is to provide a shaping tool and a device of the above-described type that is characterized by ensuring a high assembly security due to a low assembly effort in the event of a tool change and avoids the disadvantages of the above-described prior art.

This is inventively achieved for the shaping tool in that the compression head and the clamping device are constructionally connected to each other circumferentially in a single tool unit such that they are axially movable relative to each other.

In an inventive device for deforming a workpiece, such an inventive shaping tool is disposed on the common longitudinal axis of the shaping subassembly and clamping subassembly. In the inventive deforming device the assembly or a tool change become conceivably simple by the tool unit comprising the compression head and the clamping device being installed or exchanged as a whole in or on a complementary cylinder unit. Here the cylinder unit is preferably configured as a preinstalled unit, handleable separately from the shaping tool, with a housing or at least with a housing part, and comprises at least one shaping piston that is axially movably guided in a piston space. For connecting to the tool unit comprising the compression head and the clamping device, the cylinder unit includes a tool receptacle that for its part is connected to the shaping piston via suitable connecting means, for example via one or more screws.

As an advantage of the invention, in addition to a simplified tool-change process here there is the avoidance of a risk of confusion of parts in associated pairs, in particular mutually associated clamping segments and compression heads selectable in terms of size relative to tube geometry, such as outer and inner diameter of the tube. Further advantageous is the possibility of emphasizing the embodiment of the inventive shaping-tool unit in the most compact construction possible, which with a tube shaping makes realizable a larger number of possible geometries.

With regard to the axial movability of the compression head and clamping device with respect to each other, this can consist in that both parts are axially movable, but in particular also in that only the compression head is axially movable, wherein the clamping device, in particular its clamping segments, have a radial movability, at least with respect to fulfilling their function.

Further advantageous design-details and —forms of the inventive shaping-tool unit formed from the compression head and the clamping unit constructively connected thereto as well as the inventive shaping device with this shaping-tool unit are contained in the dependent claims as well as the following description.

BRIEF DESCRIPTION OF THE DRAWINGS

The invention is explained in more detail in the following with reference to two preferred exemplary embodiments.

FIG. 1 shows a perspective depiction of a first embodiment of an inventive device for the assembly of an inventive shaping tool, FIG. 2 shows, in a perspective depiction corresponding to FIG. 1, a first embodiment of the inventive shaping tool prior to the installation on the inventive device in its first embodiment according to FIG. 1, FIG. 3 shows a further perspective depiction of the first embodiment depicted in FIG. 2 of the inventive shaping tool, but from another viewing angle.

DETAILED DESCRIPTION

With regard to the following description it is explicitly emphasized that the invention is not limited to the exemplary embodiments and here also not to all or a plurality of features of described feature combinations, rather each individual partial feature of each exemplary embodiment can also have an inventive significance in itself separate from all other partial features described in combination therewith and also in combination with any features of another exemplary embodiment.

In the various features of the drawings the same parts are always provided with the same reference numbers and are therefore as a rule each only described once in the following.

Figure 4:
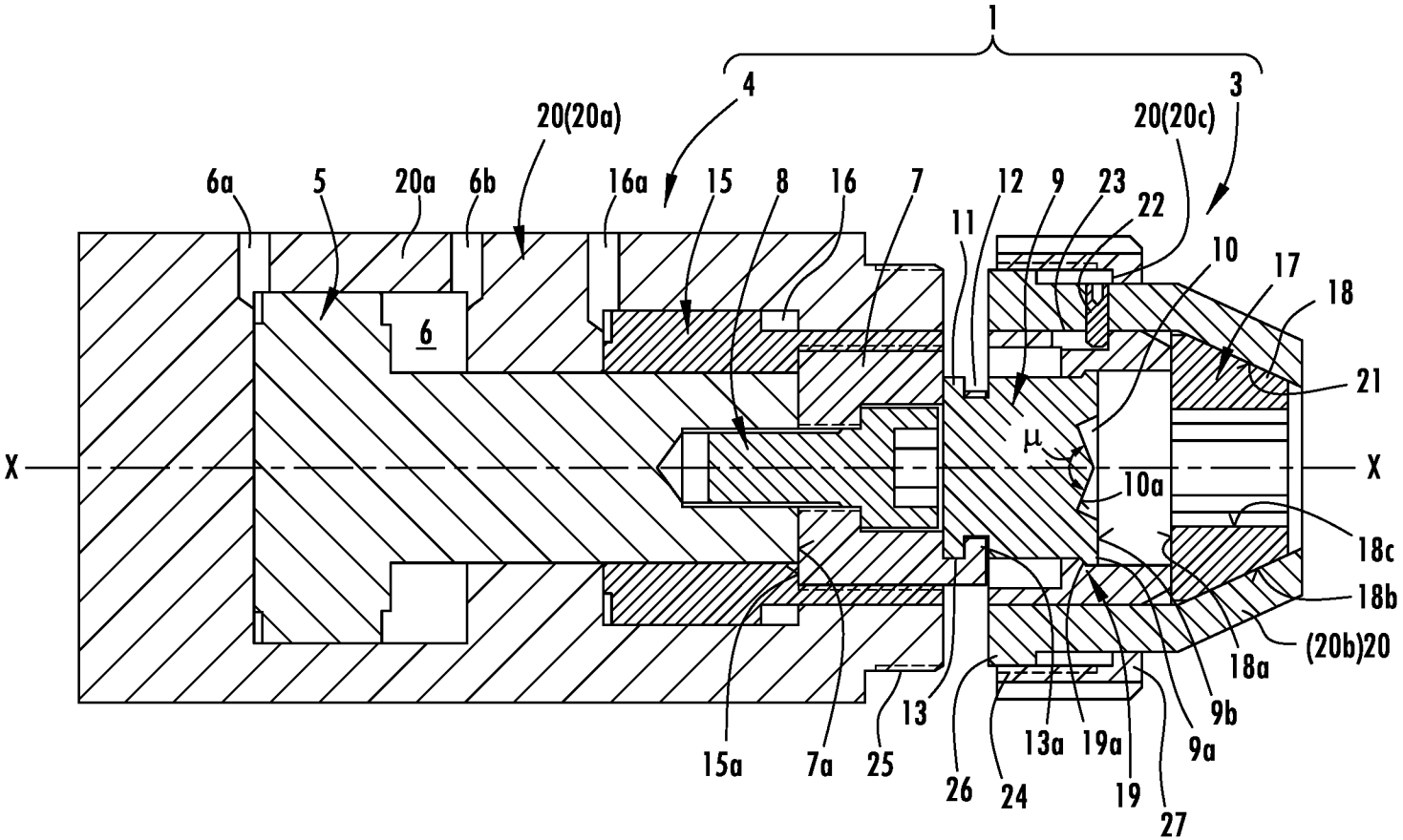
FIG. 4 shows a longitudinal section through the first embodiment of an inventive device in its installation position for the shaping tool.
Figure 5:
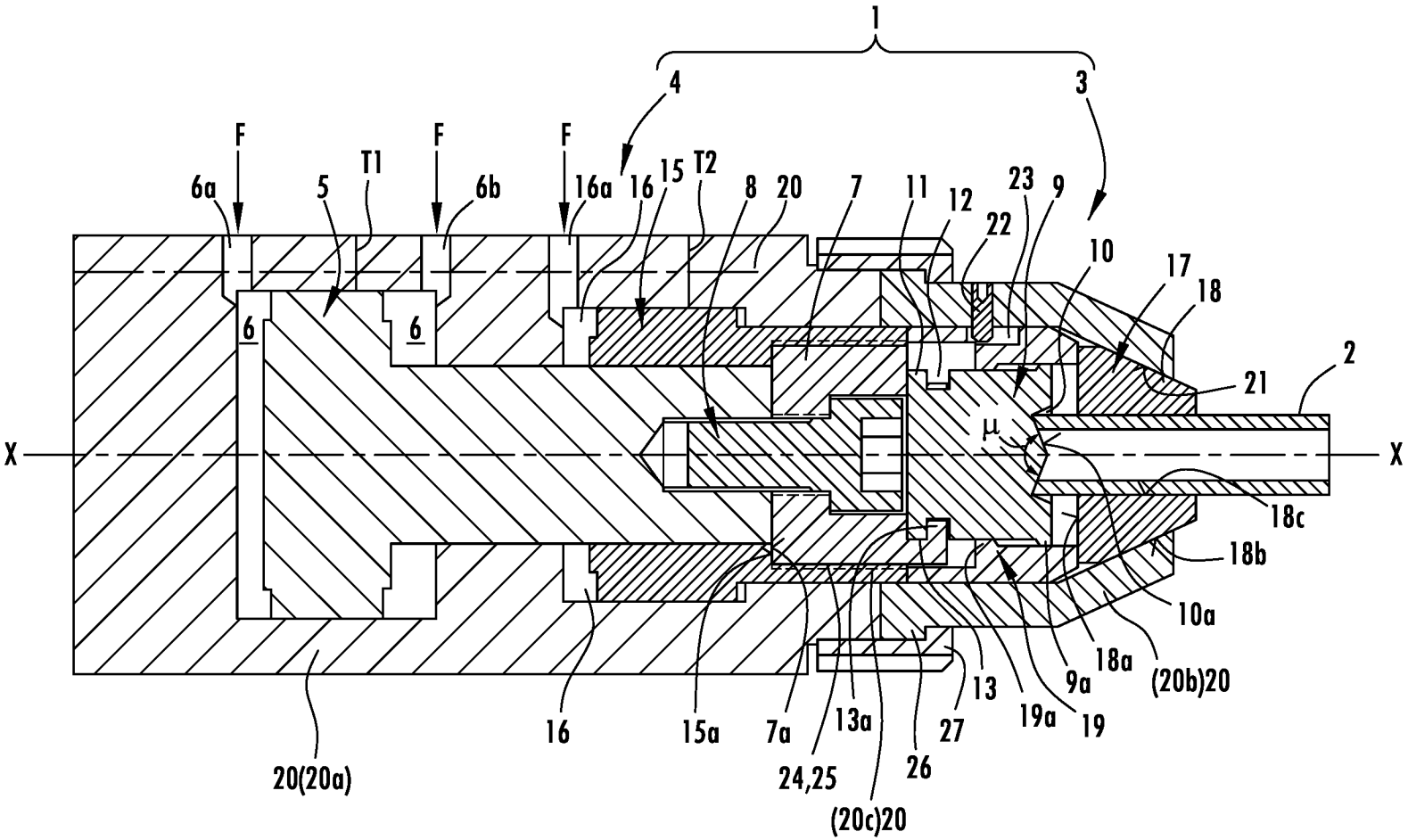
FIG. 5 shows a longitudinal section through the first embodiment of an inventive device in its work position.
Figure 6:
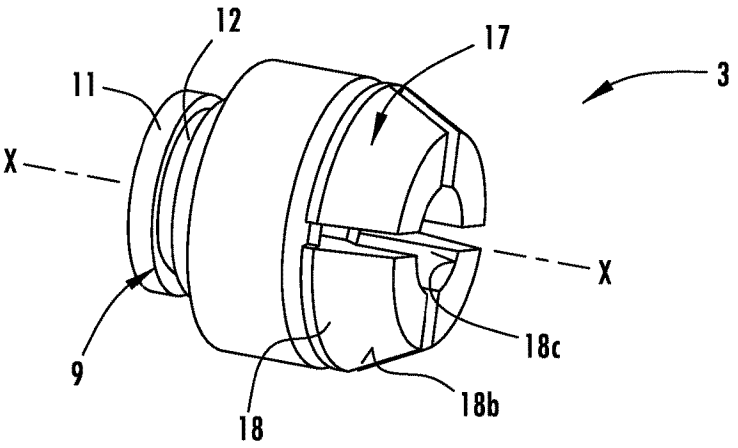
FIG. 6 shows, in a similar perspective depiction as in FIG. 2, a second embodiment of the inventive shaping tool prior to the installation on the inventive device in its second embodiment according to FIG. 7.
Figure 7:
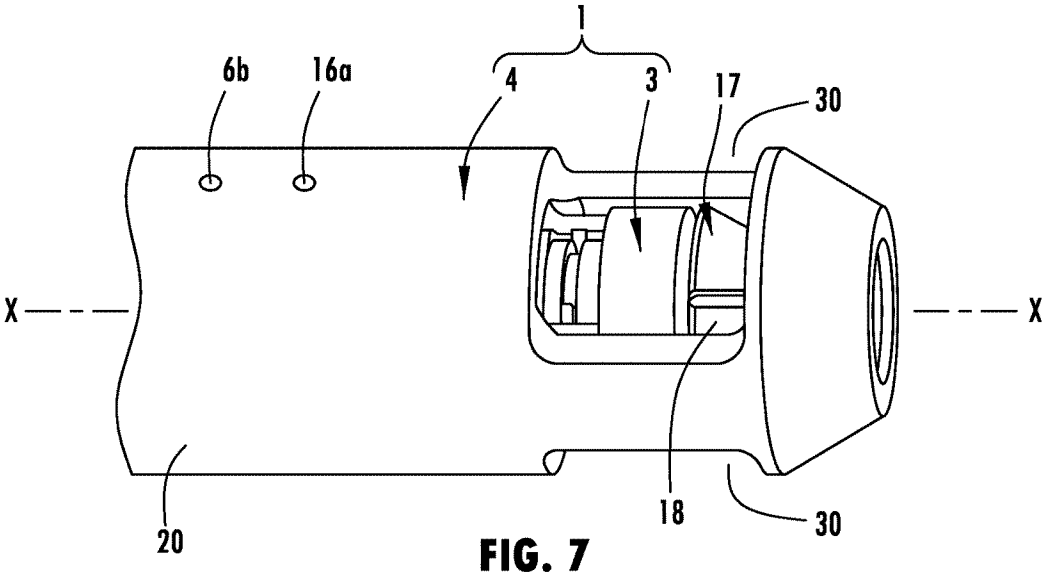
FIG. 7 shows in a perspective depiction the second embodiment of the inventive shaping tool according to FIG. 6 with the installation in the inventive device in the second embodiment.

As FIG. 1 first shows, but then also in particular FIGS. 4 and 5 show, for a first embodiment of the invention, an inventive device 1 for deforming a workpiece 2, depicted in FIG. 5 and which can also preferably be a tube, comprises a shaping subassembly actuatable by the pressure of a fluid F and a clamping subassembly disposed on a common longitudinal axis X-X and actuatable by the pressure of the fluid F.

The two subassemblies are each associated with different components corresponding to their function, which are to be concretely described in the following. These components are partially located in a shaping tool 3 (FIGS. 2, 3), inventively configured as a single tool unit, and partially in a cylinder unit 4 (FIG. 1) that receives the inventive shaping tool 3 after its installation and together with it forms the inventive shaping device 1.

With reference to FIGS. 4 and 5 the following components can respectively be associated with the two subassemblies.

The shaping subassembly comprises as the main component a shaping piston 5 disposed in the cylinder unit 4, which shaping piston 5 is longitudinally displaceable in a shaping-piston space 6 along the longitudinal axis X-X under the pressure of a fluid F. As can be seen from the drawing, the shaping piston 5 is configured as a stepped full cylinder.

In addition the shaping subassembly comprises a tool receptacle 7 also disposed in the cylinder unit 4, which tool receptacle 7 is connected to the shaping piston 5—in particular via a cylinder-head screw 8.

Finally the shaping subassembly comprises a compression head 9 belonging to the inventive shaping tool 3. This compression head 9 includes in particular on an end side a depression 10 for forming a to-be-formed contour of the workpiece 2, and on the opposing side an attachment means 11 for connection—in the depicted case indirectly via the tool receptacle 7—to the deforming piston 5. In terms of its basic design the compression head 9 is preferably also configured as a full cylinder. The attachment means 11 is configured such that the compression head 9 includes a circumferential groove 12 so that its contour is configured T-shaped—viewed in longitudinal direction—in the region of its end surface. With this T-shaped attachment means 11 the compression head 9 can engage into a corresponding—i.e., shape-matched—T-groove 13 of the tool receptacle 7. The groove 13 opens upward, axially delimited by a bridge 13*a* which extends here—as can best be seen from FIG. 1—circumferentially over a more-than-180° angular range of the tool receptacle 7 such that on the one hand and inserting of the attachment means 11 into the groove 13 is possible without problems, but on the other hand is fixed in the groove 13 in an interference-fit manner after its inserting.

When under the pressure effect of the fluid F the shaping piston executes an axial movement serving the purpose of shaping the workpiece 2, all movable parts of the shaping subassembly move axially towards the workpiece 2, i.e., with the piston 5 the tool receptacle 7 attached thereto via the cylinder-head screw 8 and finally the compression head 9.

The clamping subassembly comprises as main component a clamping piston 15 disposed in the cylinder unit 4, which clamping piston 15 is longitudinally displaceable along the longitudinal direction X-X under the pressure of the fluid F in a clamping piston space 16. The clamping piston 15 is—as visible from the drawing—configured as a radially outwardly and inwardly stepped ring cylinder. The clamping piston 15 circumferentially surrounds the end of the shaping piston 5 facing the workpiece 2, which shaping piston 5 is disposed concentrically with the clamping piston 15; the clamping piston 15 also circumferentially surrounds the workpiece receptacle 7 connected to the shaping piston 5 and is relatively movable with respect to these parts 5, 7.

For setting into movement, the clamping-piston space 16 is impingeable with the fluid F via a fluid entrance 16*a* separate from the shaping piston space 6, wherein in contrast thereto the shaping piston space 6 includes two fluid entry points 6*a*, 6*b*—a first fluid entry point 6*a* for initiating the shaping movement and a second fluid entry point 6*b* for initiating the return movement of the shaping piston 5.

To drive its return movement the clamping piston 15 needs no impinging by the fluid F because it is taken along via a radially inner lying step 15*a* when the shaping piston moves back with the tool receptacle 7 attached thereto and this step 15*a* axially comes to abutment here on a radial overhang 7*a* of the tool receptacle 7 opposite the shaping piston 5.

In addition, the clamping subassembly comprises a clamping device 17 belonging to the inventive shaping tool, which comprises a plurality of annularly disposed clamping segments 18. The clamping device 17 can preferably include four annularly disposed segments 18 that function as clamping jaws, which in the unloaded state—as is known—can preferably be held in an opening position by pressure springs disposed between them and not depicted in the drawings.

Finally the clamping subassembly comprises a retaining ring 19 also belonging to the inventive shaping tool 3, on whose one axial end of the clamping device 17 rests on its end face, while on its other axial end the compression head 9 is held in the ring interior in an axially displaceable manner, but captively due to a two-sided stop limitation of this movement. Here on the one side of the compression head 9 the stops are formed on the one hand by a radially inner lying circumferential edge crosspiece 19*a* of the retaining ring 19 and on the other hand by a complementary outer lying circumferential edge crosspiece 9*a* of the compression head 9, and on the other side of the compression head 9 on the one hand by a base surface 18*a* of the clamping segment 18 and on the other hand by a ring surface 9*b* of the compression head 9, which ring surface 9*b* surrounds the depression 10 for forming the workpiece contour.

If under the pressure effect of the fluid F, the clamping piston 15 executes an axial movement, serving the purpose of clamping the tool 2, all movable parts of the clamping subassembly move towards the workpiece 2, i.e., with the piston 15, the retaining ring, and finally the clamping device 17.

The parts of the shaping subassembly and the parts of the clamping subassembly of the inventive device 1 are enclosed by a housing 20, which is embodied multi-part in the first embodiment and cooperates with these in the fulfilling of the function of the parts of the shaping subassembly and of the parts of the clamping subassembly.

Thus, using a first hollow-cylindrically configured housing part 20*a* for the housing 20 in the cylinder unit 4 forms the wall for the shaping piston 6, wherein the two fluid entry points 6*a*, 6*b* are located. Furthermore, using the first housing part 20*a* the housing 20 forms the wall in the cylinder unit 4 for the clamping-piston space 16, wherein the fluid entry 16*a* of the clamping-piston space 16 is located therein.

In the tool unit 3, using a second housing part 20*b* that is configured as hollow-cylindrical in a first axial section and configured as a hollow truncated cone in a second tip section adjacent to the first, the housing 20 forms the wall of the tool unit 3. The truncated-cone-shaped section tapers conically—both inside and outside—pointing away from the cylinder unit 4. The clamping segments 18 of the clamping device 17 each externally include a corresponding cone surface 18*b* that abuts on the inner conically configured surface 21 of the second housing part 20*b* and interacts therewith. With an axial pressure on the base surfaces 18*a* of the clamping segments 18 these move on the one hand in axial direction X-X, on the other hand they are pressed radially inward by the wedge effect of the two surfaces 18*b*, 21, wherein during clamping, as clamping jaws, they press with their preferably roughened or toothed inner sides 18*c* on the workpiece 2, such as the tube end shown in FIG. 5. From this it is clear that the housing 20 is preferably also significant for the filling of the clamping function of the clamping subassembly.

In addition the second housing part 20*b* of the housing 20 advantageously fulfills a function in the regard that the compression head 9 and the clamping device 17 are constructively connected to each other in a single tool unit 3. From this perspective in the description of the clamping subassembly it has already been achieved that the compression head 9 is held in the interior of the retaining ring 19 in an axially displaceable manner but captively with a two-sided stop limitation. This unit of compression head 9 and retaining ring 19 is initially on the one hand held with interference fit in the second housing part 20*b* together with the—preferably not fixedly connected to the retaining ring 19—clamping device 17. Here the retaining ring 19 is also held in a longitudinally displaceable manner in the housing part 20*b* by an attachment element 22, in particular by a grub screw depicted in FIGS. 4 and 5, which engages with its point in an outer groove of the retaining ring 19. The axial length of the outer groove 23 is dimensioned here such that the retaining ring can perform the axial movement necessary for clamping and unclamping, wherein the attachment element 22 is guided in the outer groove 23 in a stop-limited manner. In this manner on the one hand the constructive cohesion of the shaping tool 3 is provided, but on the other hand its secure fulfillment of function is also ensured.

Finally in the first embodiment of the inventive device 1 the housing 20 includes a third housing part 20*c*, which serves to connect the tool unit 3 and the cylinder unit 4 to each other. In terms of type the housing part 20*c* is configured as a union nut, wherein it includes an internal thread 24 by which a screw connection 24, 25 can be produced with a circumferential external thread 25 of the cylinder unit 4, as is shown in FIG. 5. Here the tool unit 3 and the cylinder unit 4 are axially pressed against each other and thus connected to each other by corresponding collars 26, 27, which come into abutment with each other during assembly.

A tool change is thus conceivably simply designed by only the one tool unit 3 being unscrewed from the cylinder unit 4 and extracted from the T-groove 13. Thereafter another tool unit 3 can be inserted into the T-groove 13 in the next step and screwed onto the cylinder unit 4. As FIGS. 2 and 3 show, special engagement points 28 for a screw tool can be profiled for this purpose on a third housing part.

Also in the second embodiment of the invention depicted in FIGS. 6 to 10 an inventive device 1 for deforming a workpiece 2 comprises a shaping subassembly actuated by the pressure of a fluid F and a clamping subassembly disposed on a common longitudinal axis X-X and actuated by the pressure of the fluid F, as has been described above for the first embodiment.

Also in the second embodiment of the invention the inventive shaping tool 3 here includes a clamping device 17 for the workpiece 2 including a plurality of clamping segments 18 as well as a compression head 9, which serves for forming the to-be-formed contour of the workpiece 2. The compression head 9 and the clamping device 1 are constructively connected to each other circumferentially in a single tool unit 3 in a manner such that they are axially movable relative to each other.

Here there is initially a difference in the design of the housing 20, which in the second embodiment initially—as the uniform sectional hatching indicates—is depicted as one-part in a simplified manner. Specifically, however, this housing must be comprised of at least two components (in FIG. 5 two separation points T1, T2 are provided in the housing 20, i.e., 3 housing parts), wherein these parts of the housing 20 are fixedly screwed to one another (axially parallel dot-dashed lines in FIG. 5) and are not released from one another during a tool change. It is thus not comprised of—as in the first embodiment—parts 20*a*, 20*b*, 20*c* connectable to one another and releasable from one another for tool change, of which one is associated with the tool unit 3 and another with the cylinder unit 4. Instead, the housing 20, which here can be completely associated with the cylinder unit 4, includes at least one window 30, which allows a tool unit 3 to be removed from the cylinder unit 4 during a tool change and the other to be inserted again. As is particularly clear from FIG. 7, in the case depicted two diametrically opposing windows 30 are provided. Here each window 30 is formed by an opening in the casing of the hollow cylindrical housing 20. The tool change can thus advantageously be realized without the need to use additional tools.

Figure 8:
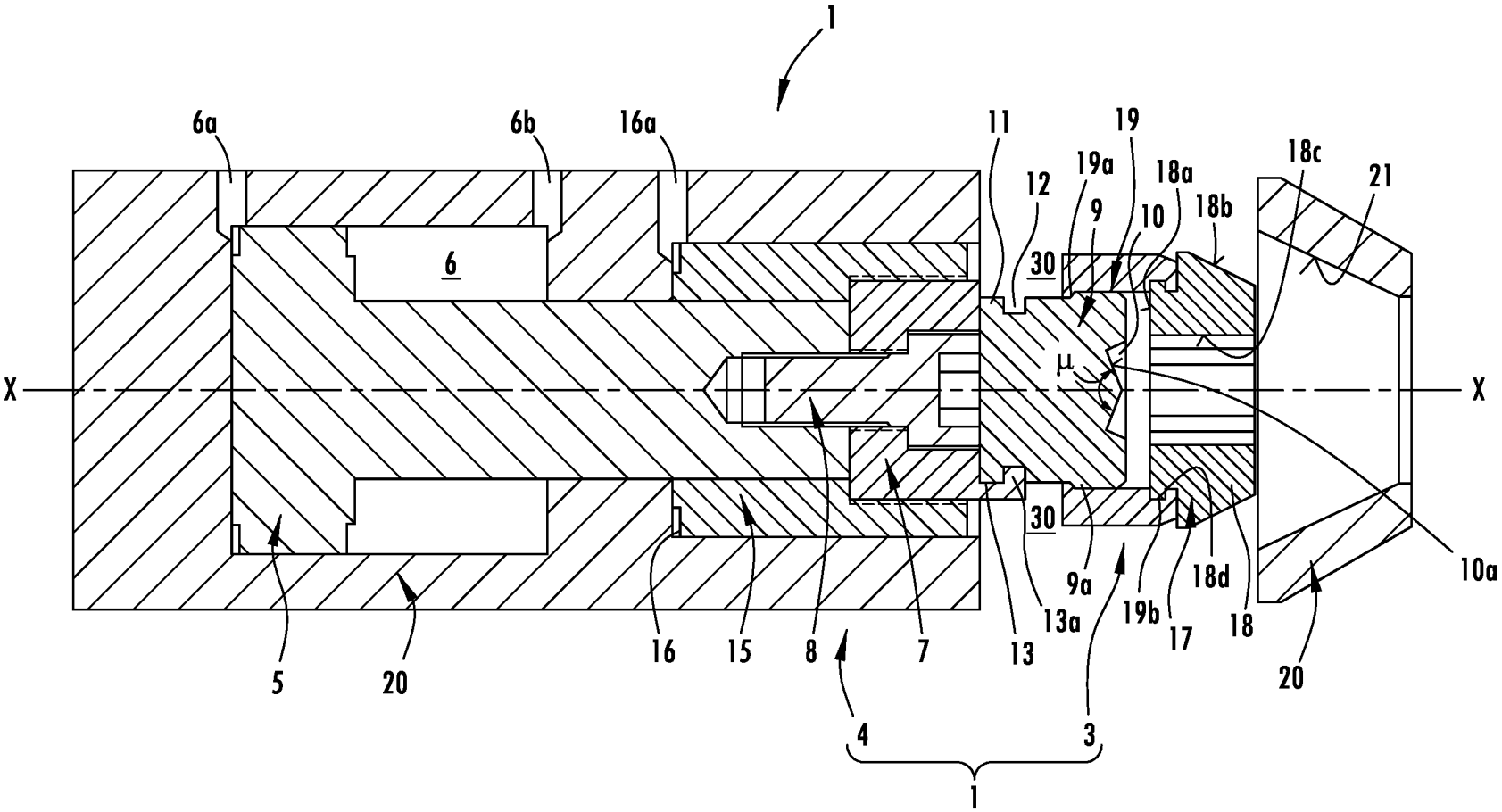
FIG. 8 shows, in front view, a longitudinal section through the second embodiment of an inventive device in the installation position of the inventive shaping tool.
Figure 9:
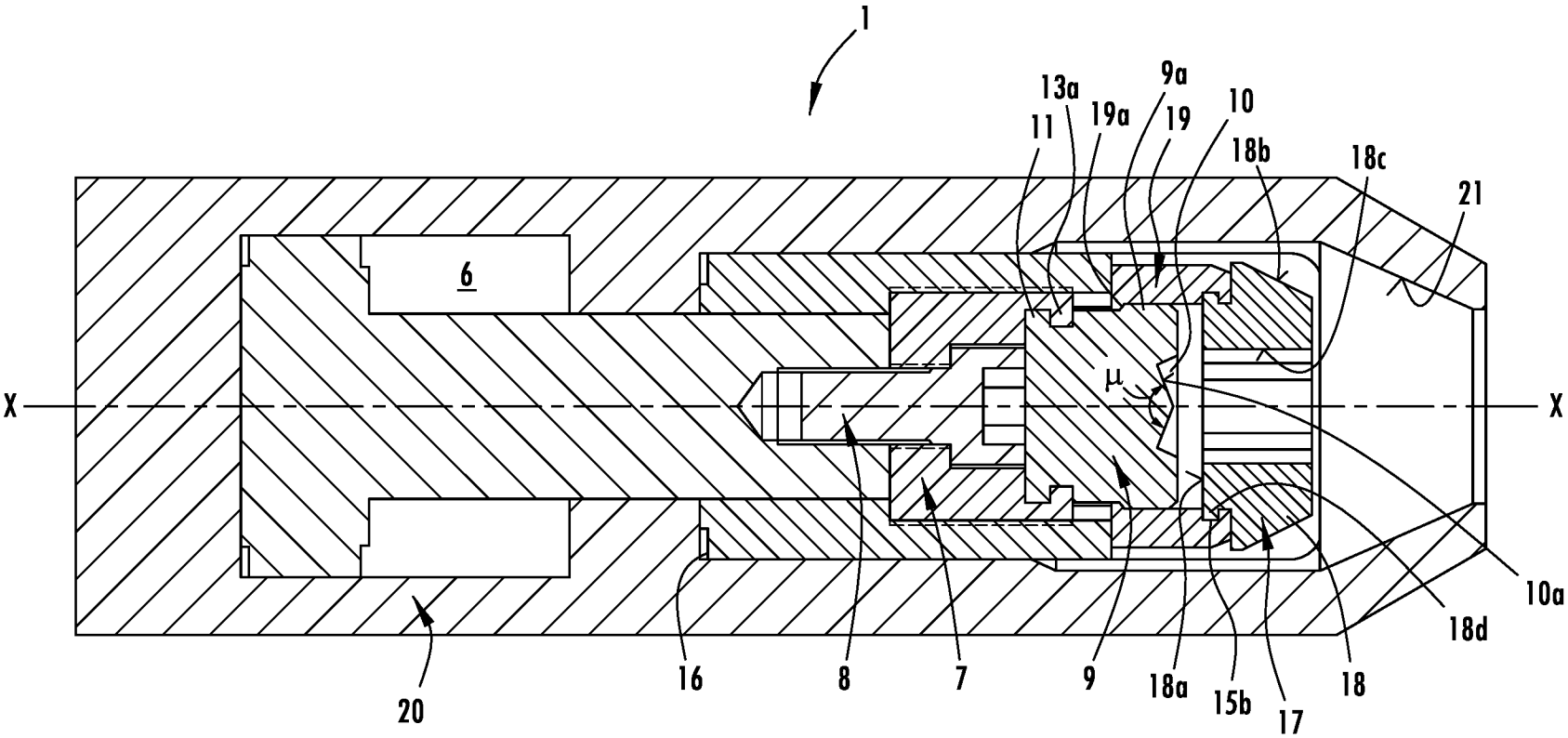
FIG. 9 shows, in a plan view corresponding to FIG. 8, a further longitudinal section through the second embodiment of an inventive device in the installation position of the inventive shaping tool.
Figure 10:
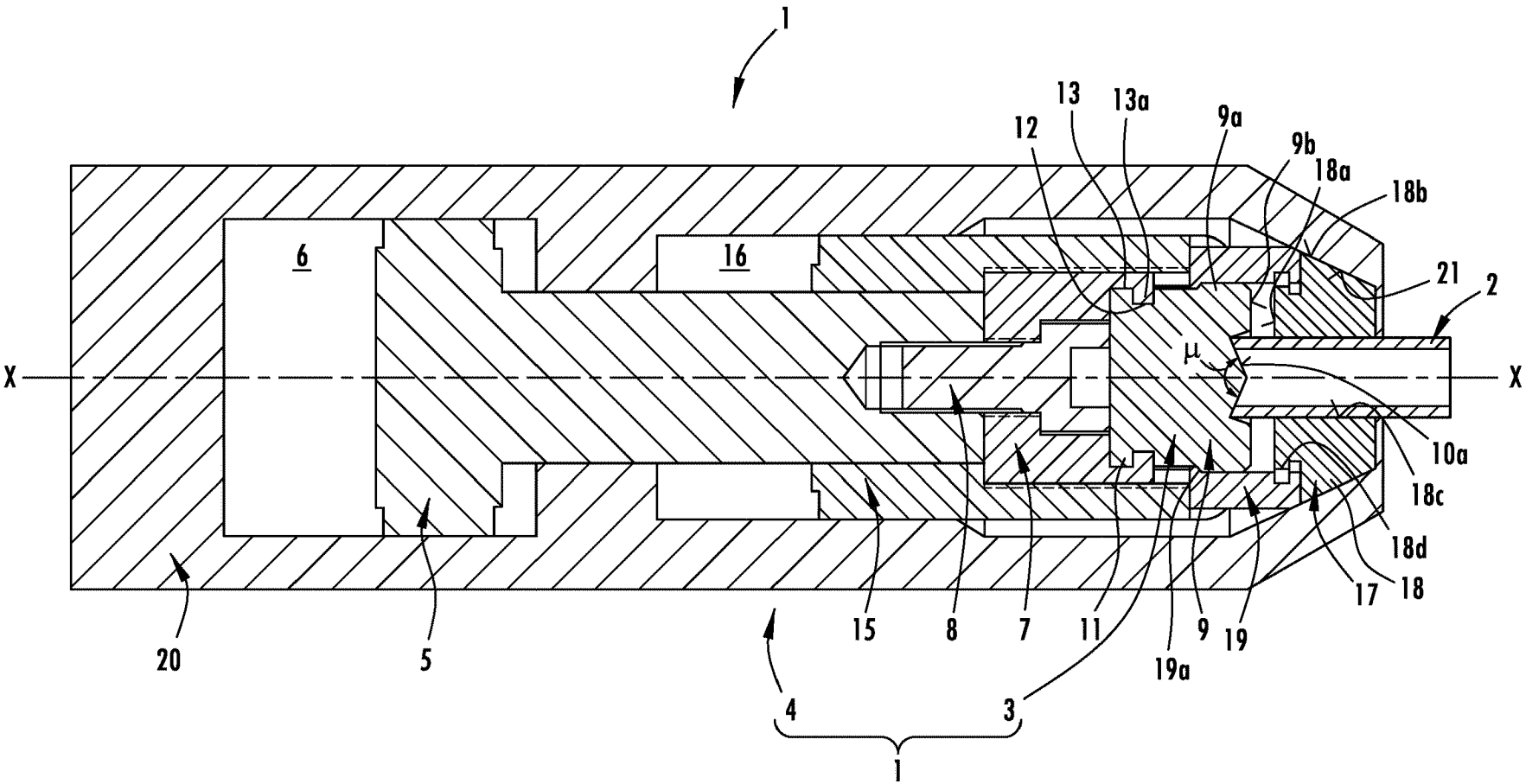
FIG. 10 shows, in a depiction as in FIG. 9, a longitudinal section through the second embodiment of an inventive device in the work position of the inventive shaping tool.

Since in the second embodiment the tool unit 3 of the inventive shaping tool 3 is not held together by a housing part 20*b*—in particular not the unit made from compression head 9 and retaining ring 19 with the segments 18 of the clamping device 17, which segments 18 are loosely inserted in the housing part 20*b*—instead a connection is provided between the retaining ring 19 and the segments 18 in particular as a friction- and interference-fit connection as is clear from FIGS. 8 to 10. For this purpose the retaining ring 19 includes an inner circumferential groove 19*b* in the region of its axial end facing away from the compression head 9, in which inner circumferential groove 19*b* each of the segments 18 are held in an interference-fit manner with a complementary flange shoulder 18*d*. Here the segments 18 are pressed centrifugally into the circumferential groove 19*b* by the not-depicted pressure springs disposed between the segments 18. To insert or remove the clamping device 17 the segments can be pressed radially inward against the spring force so that the outer diameter of the clamping device 17 decreases and the clamping device 17 can be inserted in the retaining ring 19*b* or removed from it. However, this is only necessary in the manufacturing of the preassembled shaping-tool unit 3 or in the case of wear of the segments 18 after a long period of use, not with a tool change in an inventive device 1 for deforming. Here this connection is embodied in a more constructively simple manner than the cohesion by the housing part 20*b* in the first embodiment, wherein an additional screwing with the grub screw is provided. Here compression head 9 and retaining ring 19 are connected to each other exactly as in the first embodiment.

Due to the possibility of the inserting of the tool unit 3 into the cylinder unit 4, the tool change in the second embodiment is simpler than in the first embodiment. However, since the conical tip section of the housing 20 interacting during the clamping of the workpiece 2 should not be captured by the window 30, rather the window 30 only starts directly behind the conical section in the axial direction, a somewhat larger axial length results therefrom of the inventive device 1 in its second embodiment. After the inserting of the tool unit 3 into the cylinder unit 4 (FIG. 8, 9), the inventive device 1 is initially brought into a position by an axial moving of the shaping cylinder 5 wherein the bevels 18*b*, 21 of the clamping segments 18 and of the housing abut against one another. Thereafter the workpiece 2 is inserted and preloaded by an axial moving of the clamping cylinder 15, wherein the segments 18 move radially inward and fix the workpiece. This state is depicted in FIG. 10. Only then can the uniform shaping process of the workpiece 2 start, which—since it depicted the main function of the inventive device 1—has been described above before the clamping process.

The invention is not limited to the exemplary embodiments depicted, rather the person skilled in the art can deviate from or supplement these by further appropriate technical measures without the context of the invention being departed from. Thus the compression head 9 need not necessarily include a depression 10 on its one end side for forming a to-be-formed contour of the workpiece 2. There can also be another contour there. However, if there is a depression 10, then, for example—as follows from FIGS. 4 and 5 as well as 8 to 10—it can be provided that the base surface 10*a* of the depression 10 is configured conically. An automatic matching of different tube diameter and tube wall thicknesses is thereby advantageously achieved during the clamping and shaping of the workpiece 20. For this purpose a point angle μ specifically adapted to the tube geometry can also be provided.

The invention thus far is not limited to the feature combinations defined in the independent claims, but rather can also be defined by any other combination of certain features of all individual features disclosed as a whole. This means that basically every individual feature of the independent claims can be omitted or replaced by at least one individual feature disclosed at another point of the application.

We claim:

1. A shaping tool for connecting to a shaping device for deforming a workpiece, the shaping tool comprising: a clamping device for the workpiece, the clamping device having a plurality of clamping segments, a compression head including on one side a depression for forming a to-be-formed contour of the workpiece, the compression head and the clamping device being integrally connected to each other, circumferentially, as a wholly exchangeable single tool unit and being axially movable relative to each other, the compression head including on an opposing side an attachment feature configured to removably connect the single tool unit to the shaping device.

2. The shaping tool according to claim 1, wherein the compression head is attached in a retaining ring in an axially movable manner and stop limited on both sides.

3. The shaping tool according to claim 2, wherein for axial movement of the compression head in the retaining ring the stop limiting of the compression head is formed on one side of the compression head by a radially inner lying circumferential edge crosspiece of the retaining ring and a complementary outer lying circulating circumferential edge of the compression head, and the stop limiting on the opposing side of the compression head is formed by a base surface of the clamping segments and a ring surface of the compression head, which surrounds the depression for forming the to-be-formed contour of the workpiece.

4. The shaping tool according to claim 2, wherein the clamping device is also attached in the retaining ring in addition to the compression head.

5. The shaping tool according to claim 4, wherein the retaining ring includes an inner circumferential groove adjacent an axial end facing away from the compression head, wherein each of the clamping segments of the clamping device is radially moveable and held fixed by a flange shoulder complementary to the inner circumferential groove in an interference-fit manner in the axial direction.

6. The shaping tool according to claim 1, further comprising at least one housing part.

7. The shaping tool according to claim 6, wherein the compression head attached in the retaining ring is received in the housing part together with the clamping device and the retaining ring is attached to the housing part in an axially movable manner.

8. The shaping tool according to claim 6, wherein a retaining ring is retained in the housing part in an axially longitudinally displaceable manner by a grub screw that engages in an external groove of the retaining ring.

9. The shaping tool according to claim 8, wherein a base surface of the depression of the compression head is conical.

10. The shaping tool according to claim 8, wherein the attachment feature defines, when viewed in longitudinal section, a T-shaped contour.

11. The shaping tool according to claim 1, wherein a base surface of the depression of the compression head is conical.

12. The shaping tool according to claim 1, wherein the attachment feature defines, when viewed in longitudinal section, a T-shaped contour.

13. A device for deforming a workpiece, the device comprising:

a shaping subassembly including a fluid pressure driven member, a clamping subassembly disposed on a common longitudinal axis and actuatable along the longitudinal axis by the fluid pressure driven actuator; and a shaping tool disposed along the common longitudinal axis, the shaping tool including a clamping device for the clamping of the workpiece and a compression head, the clamping device having a plurality of clamping segments, the compression head including on one side a depression for forming a portion of the workpiece, the compression head and the clamping device being integrally connected to each other circumferentially as a wholly exchangeable single tool unit and being axially movable relative to each other, the compression head including on an opposing side an attachment feature configured to removably connect the single tool unit to the shaping device.

14. The device according to claim 13, wherein the device is assembled from a cylinder unit and an exchangeable tool unit, the exchangeable tool unit being formed by the shaping tool.

* * * * *